US010384261B2

(12) United States Patent
Stuhldreier et al.

(10) Patent No.: US 10,384,261 B2
(45) Date of Patent: Aug. 20, 2019

(54) MOULD FOR PRODUCING A CASTING CORE

(71) Applicant: Martinrea Honsel Germany GmbH, Meschede (DE)

(72) Inventors: Olaf Stuhldreier, Meschede (DE); Pascal Decker, Brilon (DE); Heinrich Fuchs, Arnsberg (DE)

(73) Assignee: Martinrea Honsel Germany GmbH, Meschede (DE)

( * ) Notice: Subject to any disclaimer, the term of this patent is extended or adjusted under 35 U.S.C. 154(b) by 0 days.

(21) Appl. No.: 15/973,857

(22) Filed: May 8, 2018

(65) Prior Publication Data

US 2018/0326474 A1 Nov. 15, 2018

(30) Foreign Application Priority Data

May 9, 2017 (DE) ..... 10 2017 109 921

(51) Int. Cl.

| | |
|---|---|
| ***B22C 17/00*** | (2006.01) |
| ***B22C 9/10*** | (2006.01) |
| ***B22C 7/06*** | (2006.01) |
| ***B22C 13/12*** | (2006.01) |

(52) U.S. Cl.

CPC ..... *B22C 17/00* (2013.01); *B22C 7/06* (2013.01); *B22C 9/10* (2013.01); *B22C 13/12* (2013.01)

(58) Field of Classification Search

CPC .. B22C 17/00; B22C 7/06; B22C 9/00; B22C 9/10; B22C 9/103; B22C 9/108; B22C 9/22; B22C 9/26; B22C 13/00; B22C 13/12

See application file for complete search history.

(56) References Cited

U.S. PATENT DOCUMENTS

| | | | |
|---|---|---|---|
| 3,989,439 | A | 11/1976 | Schmitzberger |
| 2008/0274289 | A1 | 11/2008 | Sakurai et al. |

FOREIGN PATENT DOCUMENTS

| | | | |
|---|---|---|---|
| JP | H07 266000 | | 10/1995 |
| JP | 2015044217 | A * | 3/2015 |
| WO | 2012/139771 | | 10/2012 |

OTHER PUBLICATIONS

English Translation of JP 2015-044217.*

* cited by examiner

*Primary Examiner* — Kevin P Kerns
*Assistant Examiner* — Steven S Ha
(74) *Attorney, Agent, or Firm* — Gudrun E. Huckett

(57) ABSTRACT

A mold assembly for producing a casting core for a cooling jacket of an electric motor has an external mold and an internal mold enclosed by the external mold. The external mold forms an outer wall and the internal mold an inner wall of the core molding cavity fillable with a core material and having a cylindrical shape. The internal mold has two first mold shells and two second mold shells. The two first mold shells and the two second mold shells jointly form the inner wall of the core molding cavity. The second mold shells are arranged between the first mold shells. A first demolding mechanism is arranged between the first mold shells and enables movement of the first mold shells toward one another. A second demolding mechanism is arranged between the second mold shells and enables movement of the second mold shells toward one another.

10 Claims, 5 Drawing Sheets

MOULD FOR PRODUCING A CASTING CORE

BACKGROUND OF THE INVENTION

The invention relates to a mould assembly for producing a casting core which models coolant ducts and coolant inflows and outflows of a cooling jacket of an electric motor by casting.

The efficiency of modern electric motors and especially electric motors which serve for driving vehicles depends greatly on the cooling of the electric motor. Frequently, therefore, such electric motors are provided with a cooling jacket with coolant ducts extending therein, through which a cooling fluid, for example water, flows.

On account of the complexity of the shape of the coolant ducts, which can have a meandering form, for example, it may be appropriate to produce the cooling jacket in a casting process. However, this type of production requires a suitable casting core, which has to be placed within the casting mould in order to model the coolant ducts and also the necessary coolant inflows and outflows by casting. In a manner corresponding to the complexity of the coolant ducts, the casting core required for this purpose is also of relatively complex shape.

Therefore, it is the object of the invention to allow the moulding of a casting core which models the coolant ducts and coolant inflows and outflows of the cooling jacket of an electric motor by casting and which is able to be demoulded readily and without being destroyed after moulding.

SUMMARY OF THE INVENTION

According to the invention, a mould assembly for producing a casting core is proposed which models coolant ducts and coolant inflows and outflows of a cooling jacket of an electric motor by casting, comprising a core moulding cavity which is fillable with core material and comprises a substantially cylindrical shape about a central axis. The outer wall of the core moulding cavity is formed by an external mould and the inner wall is formed by an internal mould completely enclosed by the external mould. Constituent parts of the internal mould are:

- two first mould shells and two second mould shells, all four of which jointly delimit the inner wall of the core moulding cavity, wherein the second mould shells are arranged in each case between the first mould shells,
- a first demoulding mechanism, which is arranged between the first mould shells and is configured to move the first mould shells toward one another,
- a second demoulding mechanism, which is arranged between the second mould shells and is configured to move the second mould shells toward one another.

With such a mould assembly, it is possible to produce cylindrical casting cores of complex shape which can model coolant ducts and coolant inflows and outflows of the cooling jacket of an electric motor by casting. Such a cooling jacket typically comprises, in its interior, coolant ducts of meandering form which are connected overall to form a substantially cylindrical shape. In a corresponding manner, the core moulding cavity filled with core material during the production of the casting core is determined primarily by an external mould and an internal mould. Here, the external mould forms the outer wall of the core moulding cavity and the internal mould forms the inner wall of the core moulding cavity. The cylindrical internal mould is enclosed by the cylindrical external mould around its entire circumference.

Constituent parts of the internal mould are two first mould shells and two second mould shells, wherein all four mould shells jointly form and delimit the inner wall of the core moulding cavity, and wherein the second mould shells are arranged in each case in a movable manner between the first mould shells.

A constituent part of the internal mould is a first demoulding mechanism, which is arranged between the first mould shells and is configured to move the first mould shells toward one another. A constituent part of the internal mould is also a second demoulding mechanism, which is arranged between the second mould shells and is configured to move the second mould shells toward one another.

There is thus an inward movement, achieved by the two demoulding mechanisms, towards the longitudinal axis of the internal mould, as a result of which the core moulding cavity is opened or released during demoulding.

As regards the first demoulding mechanism, it is proposed that the first demoulding mechanism comprises a first shell carrier which is arranged so as to be longitudinally movable in the direction of the central axis and on which two guides are arranged, wherein one of the two first mould shells is arranged in a displaceable manner on one guide and the other of the two first mould shells is arranged in a displaceable manner on the other guide, and wherein the longitudinal directions of these two guides converge toward one another. The term converge means that the virtual axes of the two longitudinal directions of the two guides meet at a point outside the shell carrier.

As regards the second demoulding mechanism, it is proposed that the latter comprise a second shell carrier which is arranged so as to be longitudinally movable in the direction of the central axis and on which two guides are arranged, wherein one of the two second mould shells is arranged in a displaceable manner on one guide and the other of the two second mould shells is arranged in a displaceable manner on the other guide, and wherein the longitudinal directions of these two guides converge towards one another. The term converge means that the virtual axes of the two longitudinal directions of the two guides meet at a point outside the second shell carrier.

Preferably, the two shell carriers are longitudinally movable with respect to one another in the direction of the central axis, i.e. by one shell carrier being arranged in a slidable manner in the other shell carrier.

In order to achieve complete demoulding at the internal mould by a single, continuous drive movement, the guides on the one shell carrier and the guides on the other shell carrier are each oriented such that they converge in the same direction and both diverge in the opposite direction.

In order that first of all only the pair of first mould shells and only later the pair of second mould shells contract inward by way of a single, continuous drive movement, stops are formed on the shell carriers. These stops limit the mutual longitudinal movability of the shell carriers at least in the opposite direction to the convergence direction of the guides.

In order for it to be possible to construct the two mechanisms that contract the pairs of mould shells for demoulding in a compact and space-saving manner one inside the other, one of the shell carriers, including the guides arranged thereon, is formed in one part, whereas the other shell carrier, including the guides arranged thereon, is formed in two parts from two carrier portions arranged in succession in the direction of the central axis. In this case, the subdivision of the guide arranged on the other shell carrier is such that guide portions are present on each of the carrier portions, wherein the guide portions are aligned with one another.

Preferably, the shell carrier formed in one part is subdivided into two segments by a longitudinal slot, and the segments are connected together only via webs.

According to a further configuration of the mould assembly, one of the shell carriers comprises a frustoconical basic form, and the other of the shell carriers comprises a basic form comprised of a cylinder and arms protruding radially away from the cylinder. The cylinder is longitudinally guided in the other shell carrier, i.e. the frustoconical shell carrier. This contributes to a nested and thus compact structure of the two mechanisms which contract the pairs of mould shells during demoulding.

According to a further configuration of the mould assembly, the guides have a T-shaped cross section and they engage in grooves provided with corresponding undercuts in the inner sides of the respective mould shells.

Finally, it is proposed that the mutually facing inner sides of the first mould shells forming the first pair of mould shells each successively have an end portion, a middle portion and a further end portion, and that the inner sides are set back in the middle portion compared with the two end portions, forming a recess.

BRIEF DESCRIPTION OF THE DRAWINGS

Further details and advantages can be gathered from the following description of a mould assembly for producing a casting core. To this end, reference is being had to the drawings.

DESCRIPTION OF PREFERRED EMBODIMENTS

Figure 1:
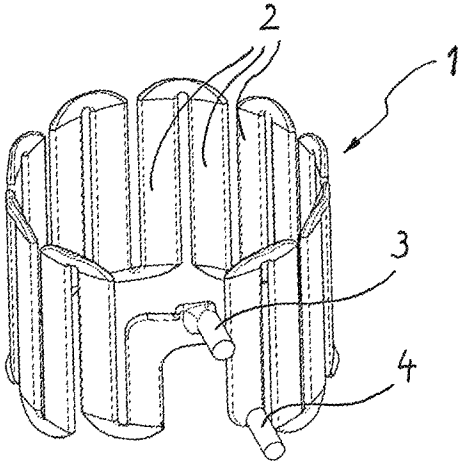
FIG. 1 shows a perspective illustration of only the product that is producible by means of the mould assembly described herein, namely a casting core which models coolant ducts and coolant inflows and outflows of the cooling jacket of an electric motor by casting.

FIG. 1 depicts a casting core 1 consisting of casting sand. The casting core 1 serves to model coolant ducts 2, a coolant inflow 3 and a coolant outflow 4 of a cooling jacket of an electric motor by casting. Therefore, when the casting core 1 is placed inside a casting mould, it defines those regions in which, following completion of casting, the coolant ducts 2, the coolant inflow 3 and the coolant outflow 4 are located.

On account of the complexity of the form of the coolant ducts 2, which have a meandering shape according to FIG. 1, it is appropriate to produce the cooling jacket used for the electric motor in a casting process.

Proposed in the following is a mould assembly with which the casting core 1 can be produced, wherein ready demoulding without destruction is desired above all.

Figure 3:
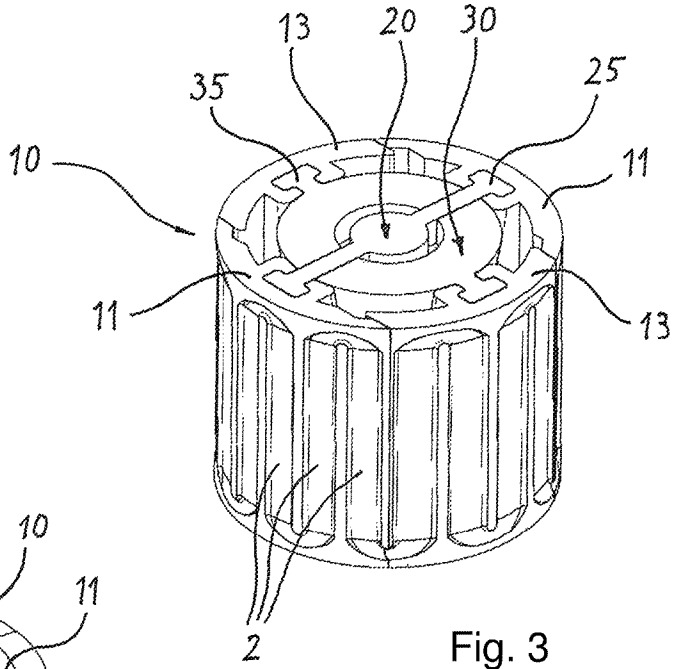
FIG. 3 likewise shows the mould assembly, but, compared with FIG. 2, without the constituent parts of the external mould.
Figure 2:
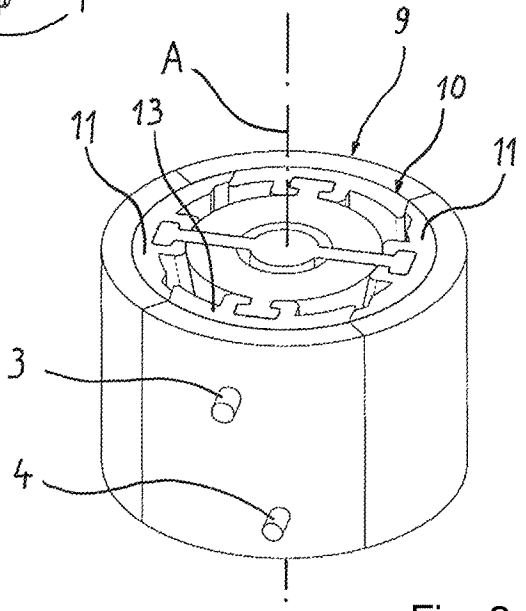
FIG. 2 shows a perspective illustration of the complete mould assembly for producing the casting core illustrated in FIG. 1.

FIG. 2 depicts the mould assembly designed according to the invention in its entirety. It is comprised of an external mould 9 and an internal mould 10, which are both arranged around a central axis A. The core moulding cavity, the shape of which is reproduced in FIG. 1 based on the article produced (casting core 1), is accordingly also of substantially cylindrical shape. The outer wall of the core moulding cavity is formed by the external mould 9, and the inner wall of the core moulding cavity is formed by the internal mould 10. Via openings that are not illustrated, the core material, i.e. casting sand, can be filled into the core moulding cavity, in which the casting sand then consolidates to form the casting core 1.

According to FIG. 2, the external mould 9 is comprised of a total of four segments, of which each segment extends approximately through a quarter circle. During demoulding, the four segments are moved radially outward, as a result of which the outer side of the produced casting core 1 is exposed.

By contrast, demoulding of the internal mould 10 cannot be carried out by simple radial movement of individual segments since the latter would collide with one another during their inward movement toward the longitudinal axis A.

Figure 4A:
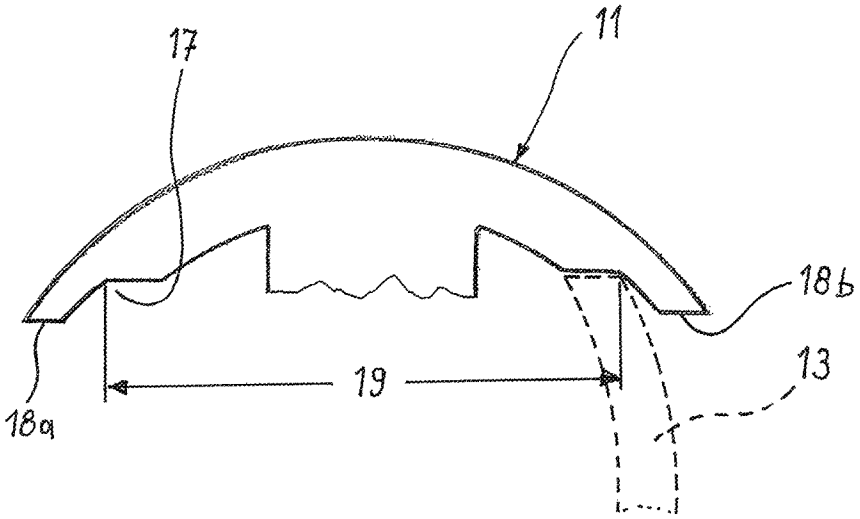
FIG. 4*a* shows an enlarged illustration of the region IV of FIG. 4.
Figure 4:
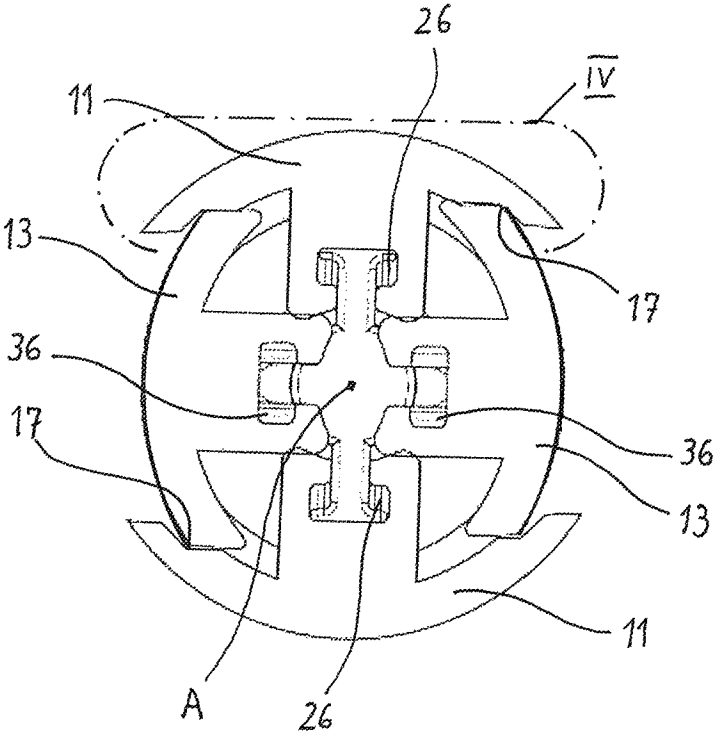
FIG. 4 shows a front view of the pairs of mould shells of the internal mould, specifically in the operating position of maximum demoulding.

Although, according to FIG. 4, the internal mould 10 is comprised of four segments which combine to form a cylinder overall and form the inner wall of the core moulding cavity on their outer sides, the four segments are not of uniform size and uniform shape. Rather, two segments are configured as first mould shells 11 and two further segments are configured as second mould shells 13. All four mould shells 11, 13 jointly delimit the inner wall of the core moulding cavity, wherein the second mould shells 13 are arranged in each case between the first mould shells 11. Since the second mould shells 13 are arranged in each case between the first mould shells 11, the two second mould shells 13 can be moved inward toward the central axis A of the internal mould 10 without in the process butting against the two first mould shells 11.

FIG. 4 and FIG. 4*a* depict the result of the different design of the mould shells 11, on the one hand, and the mould shells 13, on the other hand. FIG. 4 shows that the two second mould shells 13 have been moved radially inward, but are still located between the first mould shells 11. At the same time, the first mould shells 11 are each provided with a recess 17 at the locations where the edges, directed in the circumferential direction, of the second mould shells 13 are located in the operating position according to FIG. 4.

According to FIG. 4*a*, the recesses 17 in the first mould shells 11 are realized in that the mutually facing inner sides of the two first mould shells 11 each successively have an end portion 18*a*, a middle portion 19 and a further end portion 18*b*. The inner sides of the first mould shells 11 are set back in the middle portion 19 compared with the two end portions 18*a*, 18*b*, forming in each case the recess 17. This is additionally illustrated in FIG. 4*a* in that one of the two second mould shells 13 is also indicated by dashed lines.

Figures 9A, 9B, 10:
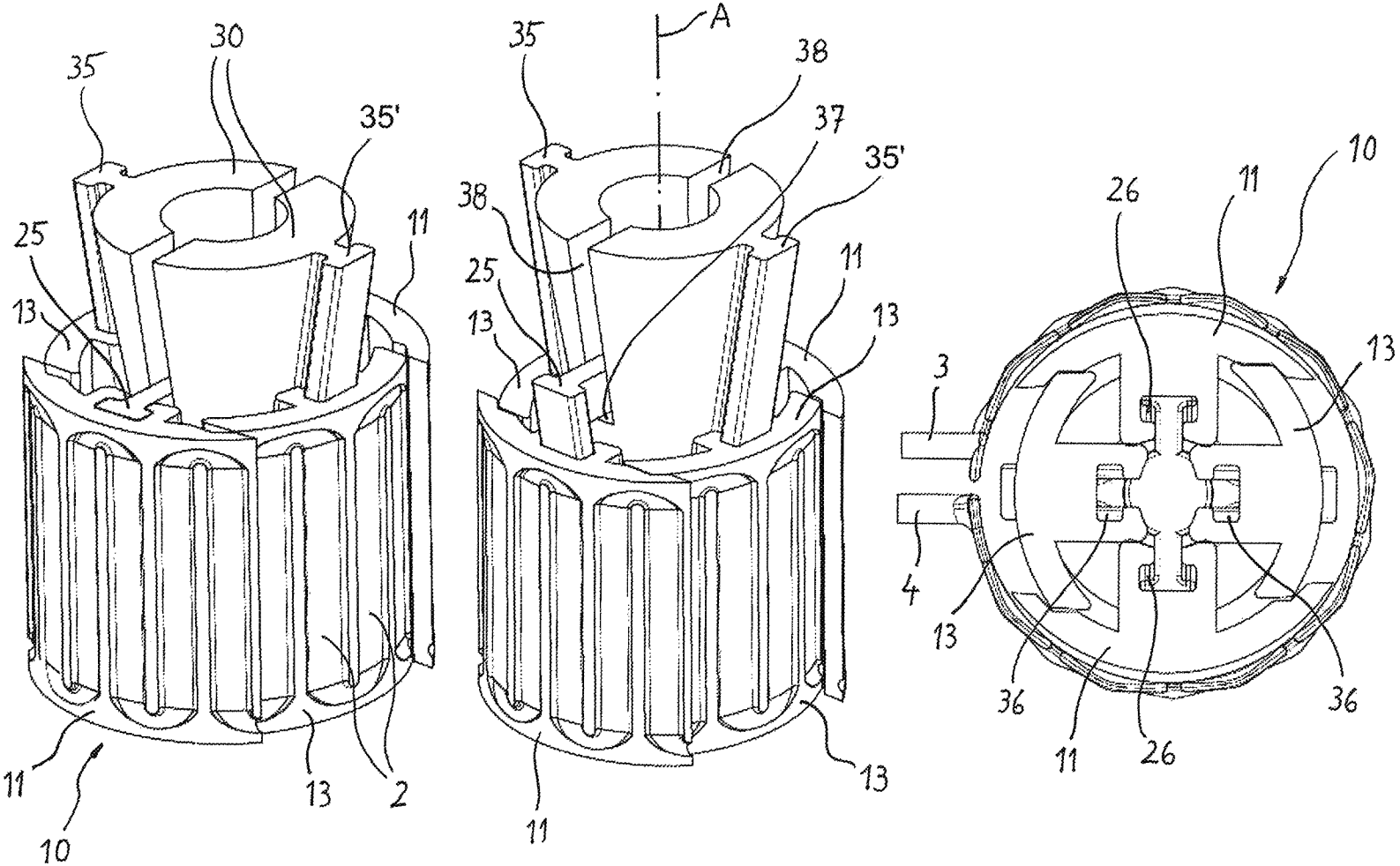
FIG. 9*a* shows the mould in an operating position in which only the two second mould shells have been demoulded.
FIG. 9*b* shows the mould in an advanced operating position, in which the two first mould shells have also been demoulded.
FIG. 10 shows a front view of all the mould shells in the operating position according to FIG. 9*b*.

Furthermore, FIGS. 4 and 10, which depict the pairs of mould shells 11, 13 in each case in the operating position of maximum demoulding, reveal the different circumferential size of the mould shells 11, on the one hand, and the mould shells 13, on the other hand. The first mould shells 11 each extend over a greater circumferential angle than the second mould shells 13. For example, the first mould shells 11 can each extend over a circumferential angle of 100°, whereas the second mould shells 13 each extend only over a circumferential angle of 80°.

Further constituent parts of the internal mould 10 are two demoulding mechanisms, by way of which the mould shells 11, 13 can be moved in the direction of the central axis A. A first demoulding mechanism is arranged between the first mould shells 11 and configured to move these first mould shells 11 toward one another. Analogously, a second demoulding mechanism is arranged between the second mould shells 13 and configured to move the second mould shells 13 toward one another.

Figure 7:
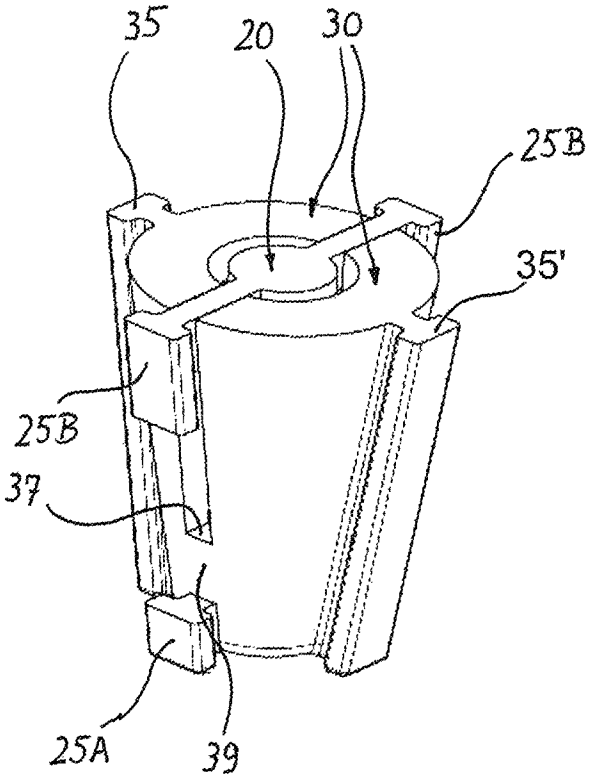
FIG. 7 shows the two shell carriers, one inside the other, specifically in the moulding position.
Figure 6:
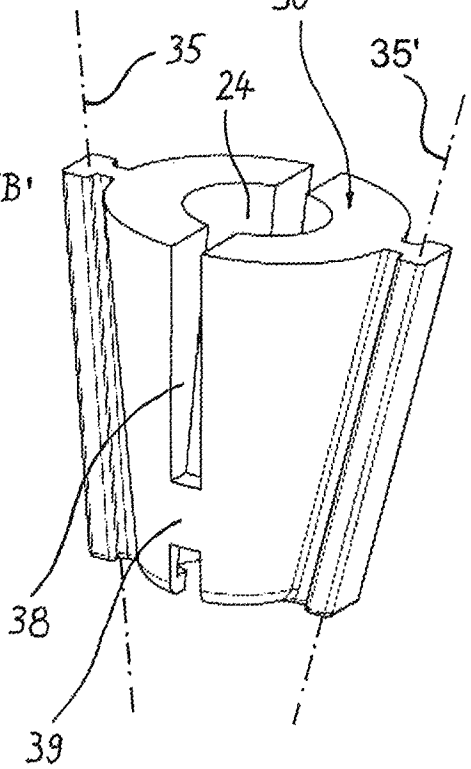
FIG. 6 shows a perspective illustration in isolation of only a second shell carrier of the internal mould.
Figure 5:
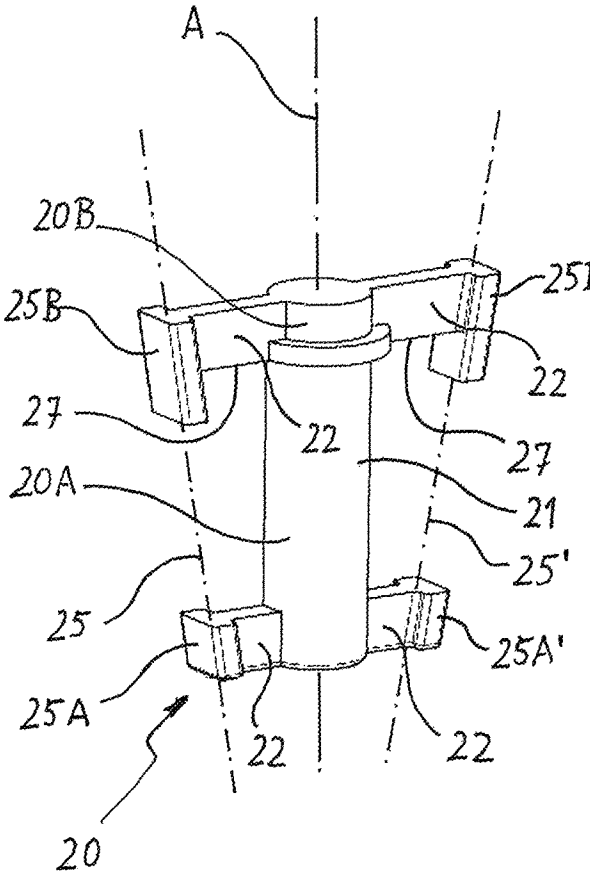
FIG. 5 shows a perspective illustration in isolation of only a first shell carrier of the internal mould.

In both cases, the mechanism is an oblique guide of the two mould shells on a shell carrier. A total of two shell carriers are provided. FIG. 5 depicts the first shell carrier 20, which is of two-part construction here, and FIG. 6 depicts the second shell carrier 30, which is designed in one part here. FIG. 7 shows the two shell carriers 20, 30 in a state with one arranged inside the other. This is at the same time the operating position during the moulding process.

The first shell carrier 20 comprises a basic form comprised of a central cylinder 21 and four arms 22 protruding radially away therefrom. The cylinder 21 is of such a size that it can slide in a substantially play-free manner in a cylindrical opening 24 with which the second shell carrier 30 is provided.

Integrally formed on the outer ends of the four arms 22 are guide portions 25A, 25B, 25A', 25B'. The guide portions 25A, 25B, 25A', 25B' each have a T-shaped cross section and are designed such that they slide in a play-free manner in grooves 26 of undercut design in the inner sides of the first mould shells 11.

In order that the two shell carriers 20, 30, as depicted in FIG. 7, are able to be mounted one inside the other, the first shell carrier 20 is formed in two parts from two carrier portions 20A, 20B that are arranged in succession in the direction of the axis A. The carrier portion 20A comprises the cylinder 21 and the two radially protruding arms on which the two guide portions 25A, 25A' are located. The other carrier portion 20B, configured in a shorter manner by comparison, comprises the two other arms 22, on the ends of which the two guide portions 25B, 25B' are integrally formed.

The design of the first shell carrier 20 is such that the guide portions 25A and 25B; 25A' and 25B' arranged on the same side of the axis A are aligned with one another, and therefore jointly form a guide 25; 25' that is interrupted in a middle portion. The first guide 25 comprised of the guide portions 25A and 25B on the one side of the axis A and the second guide 25' comprised of the guide portions 25A' and 25B' on the other side of the axis A each extend at an angle to the axis A, and the first and second guides 25, 25' converge toward one another, as illustrated in FIG. 5 by the dashed line illustrating the direction of the guides 25, 25'.

Figure 8:
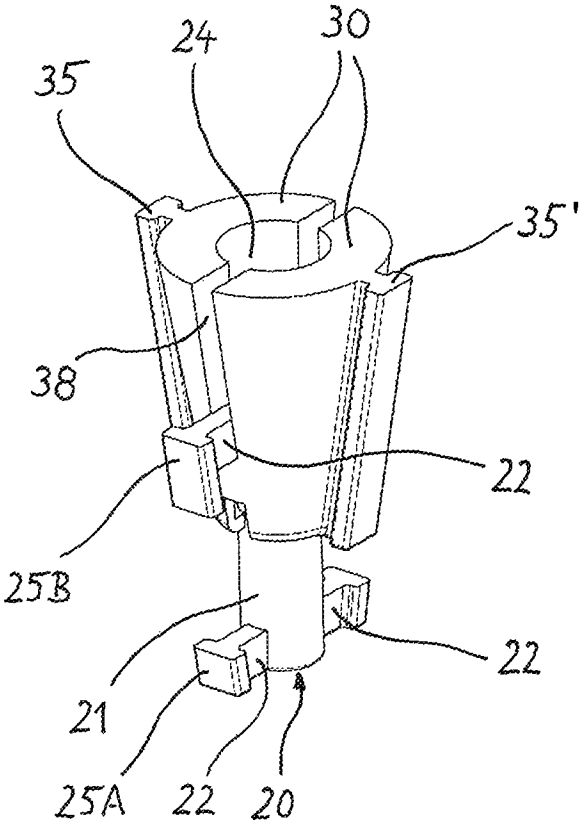
FIG. 8 shows the two shell carriers, one inside the other, in the operating position of maximum demoulding.
Figure 8A:
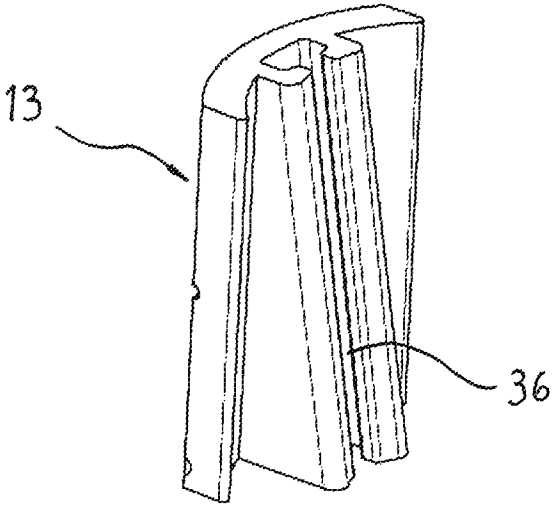
FIG. 8*a* shows a perspective view of the second mould shell with undercut groove.

The second shell carrier 30, depicted in FIG. 6, comprises a frustoconical basic form. On its mutually opposite sides with respect to the central axis A, first and second guides 35, 35' of T-shaped cross section are integrally formed in each case. The guides 35, 35' engage, in a slidable manner, grooves 36 in the second mould shells 13 (FIG. 8*a*). To this end, the grooves 36 in the second mould shells 13 are provided with corresponding undercuts.

The frustoconical shell carrier 30 centrally comprises the cylindrical opening 24, in which the cylinder 21 of the other shell carrier 20 is mounted in a longitudinally movable manner.

The shell carrier 30 is formed in one piece and is subdivided into two substantially semi-conical segments by a longitudinal slot 38 that affords space for the arms 22; these semi-conical segments are connected together only by two webs 39. A stop 37 is located at the end of each longitudinal slot 38. The corresponding counterpart stop 27 is located on the two longer arms 22 of the first shell carrier 20, respectively. The stops 37 formed on the shell carrier 30 jointly limit, together with the stops 27 formed on the shell carrier 20, the mutual longitudinal movability of the shell carriers 30, 20 in the opposite direction to the convergence of the guides 35, 25.

FIGS. 9*a* and 9*b* illustrate, in two different operating positions, the operation of the two demoulding mechanisms.

In the operating position according to FIG. 9*a*, each of the two second mould shells 13 is moved inward by a longitudinal movement of the second shell carrier 30 in the direction of the central axis A. The two first mould shells 11 do not yet carry out any inward movement at this time.

In the operating position according to FIG. 9*b*, the second shell carrier 30 has been moved further along the axis A and the stop 37 has already butted against the stop 27. As soon as these stops 27, 37 butt against one another, the shell carrier 20 is entrained by the longitudinal movement of the shell carrier 30; from this point on, both shell carriers 20, 30 move jointly in the direction of the central axis A. As soon as the first shell carrier 20 also moves in the longitudinal direction, the first shell carrier 20 moves the first mould shells 11 inward via its guides 25, 25' so that these circumferential regions are also demoulded.

Overall, demoulding thus takes place in two stages (first the second mould shells 13 are moved and only then the first mould shells 11) but by means of a single drive movement that is preferably carried out continuously. This drive movement is achieved by a continuous longitudinal movement of the second shell carrier 30, which automatically entrains the first shell carrier 20 after a certain longitudinal travel.

Materials for the internal mould 10 can be plastic, metal or wood.

Suitable as core material of the casting core 1 are sand or pourable oxidic substances or mixtures of substances which contain inorganic or organic binders, wherein these substances or mixtures of substances harden thermally and/or chemically.

The specification incorporates by reference the entire disclosure of German priority document 10 2017 109 921.2 having a filing date of May 9, 2017, of which the instant application claims priority.

While specific embodiments of the invention have been shown and described in detail to illustrate the inventive principles, it will be understood that the invention may be embodied otherwise without departing from such principles.

LIST OF REFERENCE CHARACTERS

1 casting core
2 coolant duct
3 coolant inflow
4 coolant outflow
9 external mould
10 internal mould
11 first mould shell
13 second mould shell
17 recess
18*a* end portion
18*b* end portion
19 middle portion
20 first shell carrier
20A carrier portion
20B carrier portion
21 cylinder
22 arm
24 opening
25, 25' guide
25A guide portion
25B guide portion
26 groove
27 stop
30 second shell carrier
35, 35' guide
36 groove
37 stop
38 longitudinal slot
39 web
A central axis, longitudinal axis

What is claimed is:

1. A mould assembly for producing a casting core (1) which models coolant ducts (2) and coolant inflows and outflows (3, 4) of a cooling jacket of an electric motor by casting, the mould assembly comprising an external mould (9) and an internal mould (10) completely enclosed by the external mould (9), wherein the external mould (9) forms an outer wall of a core moulding cavity and the internal mould (10) forms an inner wall of the core moulding cavity, wherein the core moulding cavity is configured to be filled with a core material and comprises a substantially cylindrical shape about a central axis (A) of the mould assembly, wherein the internal mould (10) comprises:

two first mould shells (11) and two second mould shells (13), wherein the two first mould shells and the two second mould shells jointly form the inner wall of the core moulding cavity, wherein the second mould shells (13) each are arranged between the first mould shells (11), a first demoulding mechanism arranged between the first mould shells (11) and configured to move the first mould shells (11) toward one another, wherein the first demoulding mechanism comprises a first shell carrier (20) arranged to be longitudinally movable in a direction of the central axis (A), wherein the first shell carrier (20) comprises a first guide (25) and a second guide (25'), wherein one of the two first mould shells (11) is arranged in a displaceable manner on the first guide (25) and the other one of the two first mould shells (11) is arranged in a displaceable manner on the second guide (25'), and wherein the first and second guides each have a longitudinal direction and the longitudinal directions of the first and second guides (25, 25') converge in a first convergence direction, a second demoulding mechanism arranged between the second mould shells (13) and configured to move the second mould shells (13) toward one another, wherein the second demoulding mechanism comprises a second shell carrier (30) arranged to be longitudinally movable in a direction of the central axis (A), wherein the second shell carrier (30) comprises a first guide (35) and a second guide (35'), wherein one of the two second mould shells (13) is arranged in a displaceable manner on the first guide (35) of the second shell carrier (30) and the other one of the two second mould shells (13) is arranged in a displaceable manner on the second guide (35') of the second shell carrier (30), and wherein the first and second guides (35, 35') of the second shell carrier (30) each have a longitudinal direction and the longitudinal directions of the first and second guides (35, 35') of the second shell carrier (30) converge in a second convergence direction, wherein the second shell carrier (30) and the first and second guides (35, 35') of the second shell carrier (30) are formed together as one part, wherein the first shell carrier (20) is of a two-part construction and comprised of a first carrier portion (20A) and a second carrier portion (20B) arranged in succession in the direction of the central axis.

2. The mould assembly according to claim 1, wherein the first shell carrier (20) and the second shell carrier (30) are configured to be longitudinally movable relative to one another in the direction of the central axis (A).

3. The mould assembly according to claim 2, wherein the longitudinal directions of the first and second guides of the second shell carrier (30) and the longitudinal directions of the first and second guides (25, 25') of the first shell carrier (20) converge in the same direction.

4. The mould assembly according to claim 2, wherein the first shell carrier comprises first stops (27) and wherein the second shell carrier comprises second stops (37), wherein the first and second stops (27, 37) interact with each other to limit a mutual longitudinal movability of the first and second shell carriers (30, 20) at least in a direction opposite to the first and second convergence directions.

5. The mould assembly according to claim 2, wherein the second shell carrier (30) comprises a frustoconical basic form, wherein the first shell carrier (20) comprises a basic form comprised of a cylinder and arms protruding radially away from the cylinder, and wherein the cylinder is longitudinally guided in the second shell carrier (30).

6. The mould assembly according to claim 2, wherein the first and second mould shells (11, 13) comprise grooves (36, 26) of an undercut design disposed in inner sides of the first and second mould shells, wherein the first and second guides (25, 25') of the first shell carrier and the first and second guides (35, 35') of the second shell carrier comprise a T-shaped cross section and engage the grooves of the first and second mould shells.

7. The mould assembly according to claim 1, wherein the first guide (25) of the first shell carrier is divided into two first guide portions (25A, 25B), wherein one of the first guide portions is arranged at the first carrier portion and the other one of the first guide portions is arranged at the second carrier portion, wherein the second guide (25') of the first shell carrier is divided into two second guide portions (25A', 25B'), wherein one of the second guide portions is arranged at the first carrier portion and the other one of the second guide portions is arranged at the second carrier portion, wherein the first guide portions (25A, 25B) are aligned with each other and the second guide portions (25A', 25B') are aligned with each other.

8. The mould assembly according to claim 1, wherein the second shell carrier (30) is subdivided into two segments by a longitudinal slot (38), wherein the segments are connected together by webs (39).

9. The mould assembly according to claim 1, wherein the two first mould shells (11) each comprise an inner side and the inner sides are facing each other, wherein the inner sides each comprise successively a first end portion (18*a*), a middle portion (19), and a second end portion (18*b*), and wherein the middle portion is set back relative to the first and second end portions (18*a*, 18*b*) and forms a recess (17).

10. The mould assembly according to claim 1, wherein the second demoulding mechanism comprises a second shell carrier (30) arranged to be longitudinally movable in a direction of the central axis (A), wherein the second shell carrier (30) comprises a first guide (35) and a second guide (35'), wherein one of the two second mould shells (13) is arranged in a displaceable manner on the first guide (35) and the other one of the two second mould shells (13) is arranged in a displaceable manner on the second guide (35'), and wherein the first and second guides each have a longitudinal direction and the longitudinal directions of the first and second guides (35, 35') converge in a second convergence direction.

* * * * *